US007439839B2

(12) United States Patent
Podlisk et al.

(10) Patent No.: US 7,439,839 B2
(45) Date of Patent: Oct. 21, 2008

(54) HIGH-CURRENT ELECTRICAL COIL, AND TRANSFORMER CONSTRUCTION INCLUDING SAME

(75) Inventors: Ilia Podlisk, Nazareth Ilit (IL); George Rucareanu, Nesher (IL)

(73) Assignee: Nemic-Lambda Ltd., Carmiel (IL)

( * ) Notice: Subject to any disclaimer, the term of this patent is extended or adjusted under 35 U.S.C. 154(b) by 353 days.

(21) Appl. No.: 11/341,387

(22) Filed: Jan. 30, 2006

(65) Prior Publication Data

US 2007/0176722 A1 Aug. 2, 2007

(51) Int. Cl.
*H01F 5/00* (2006.01)

(52) U.S. Cl. ..... 336/200

(58) Field of Classification Search ..... 336/65, 336/83, 200, 206–208, 232
See application file for complete search history.

(56) References Cited

U.S. PATENT DOCUMENTS 5,179,365 A * 1/1993 Raggi ..... 336/65
5,559,487 A * 9/1996 Butcher et al. ..... 336/178
5,777,539 A * 7/1998 Folker et al. ..... 336/200
6,154,111 A * 11/2000 Rehm et al. ..... 336/83
6,420,953 B1 * 7/2002 Dadafshar ..... 336/200
6,522,233 B1 * 2/2003 Kyoso et al. ..... 336/200
6,636,140 B2 * 10/2003 Fujiyoshi et al. ..... 336/200

* cited by examiner

*Primary Examiner*—Tuyen T. Nguyen

(57) ABSTRACT

An electrical coil includes first and second electrically-conductive elements each of a thin, flat, annular configuration formed with a gap to define the turns of a 2-turn coil, and an electrically insulative element also of a thin, flat, annular configuration disposed coaxially between the two electrically-conductive elements and formed with a gap aligned with one end of each turn to permit the ends to be electrically connected together. Also described is a transformer having a secondary winding including a plurality of such 2-turn coils, and a primary winding of a plurality of double-coils each connected together at their mid-portions.

10 Claims, 10 Drawing Sheets

HIGH-CURRENT ELECTRICAL COIL, AND TRANSFORMER CONSTRUCTION INCLUDING SAME

FIELD AND BACKGROUND OF THE INVENTION

The present invention relates to electrical coils, and to transformer constructions including such electrical coils. The invention is particularly useful with respect to high-current, low-leakage transformers, and is therefore described below with respect to such a transformer construction.

High-current, low-leakage transformers are commonly used in power supplies for supplying low DC voltages, e.g. in computers. Such power supplies should be characterized by: small and compact construction, in order to occupy a minimum of volume; low creepage and efficient operation at high frequencies, in order to reduce heat losses and prevent excessive temperature rises; and low leakage inductance to enable high frequency operation. In addition, they should be constructed of a relatively few simple parts which can be produced and assembled in volume and at relatively low cost.

Many such power supplies have been developed and are described in the patent literature, e.g., in U.S. Pat. Nos. 5,331,536, 5,684,445 and 5,886,610. U.S. Pat. No. 5,331,536, for example, describes a low leakage high current transformer having a secondary winding in the form of an electrical coil including a first electrically-conductive element of a thin, flat, annular configuration formed with a gap to define a first turn of the coil; and a second electrically-conductive element also of a thin, flat, annular configuration and formed with a gap to define a second turn of the coil. The second electrically-conductive element is disposed coaxially with respect to, and insulated from, the first electrically-conductive element. This is done by interleaving the first and second electrically-conductive elements with the turns of the primary winding, which is made of enamel-coated copper ribbon wire, such that the enamel serves to electrically insulate adjacent turns of the primary winding from each other and from the turns of the secondary winding. Such a construction, however, is relatively expensive to produce in volume.

OBJECTS AND BRIEF SUMMARY OF THE PRESENT INVENTION

An object of the present invention is to provide an electrical coil particularly useful for high-current transformers which can be produced in volume at relatively low cost. Another object of the invention is to provide a high current electrical coil particularly useful in constructing small, compact and efficient transformers. A further object of the present invention is to provide a transformer which can be operated efficiently, and can be produced in a small and compact form in volume and at relatively low cost.

According to one aspect of the present invention, there is provided an electrical coil of at least two turns, comprising: a first electrically-conductive element of a thin, flat, annular configuration formed with a gap to define a first turn of the coil; a second electrically-conductive element also of a thin, flat, annular configuration and also formed with a gap to define a second turn of the coil, the second electrically-conductive element being disposed coaxially with respect to the first electrically-conductive element; and electrical insulation between the first and second electrically-conductive elements insulating the first turn from the second turn except for one end of each turn to be electrically connected together; characterized in that the insulation includes an electrically insulative element also of a thin, flat, annular configuration disposed coaxially between the first and second electrically-conductive elements and formed with a gap aligned with the one end of each turn to permit the ends to be electrically connected together.

According to further features in the preferred embodiments of the invention described below, the ends of the two turns to be electrically connected together are electrically joined by soldering or welding. In addition, the first, and second electrically-conductive elements, and the electrically insulative element, are of circular configuration.

According to another feature in the described preferred embodiments, each of the first and second electrically-conductive elements is formed with first and second projecting end portions on opposite sides of the gap in the respective element; said first projecting end portions of the two electrically-conductive elements being angularly spaced from each other to define two terminals of the 2-turn coil; said second of the projecting end portions of the two electrically-conductive elements being aligned with each other to define a center tap for the 2-turn coil.

According to a still further feature in the described preferred embodiments, the inner edge of one of the electrically-conductive elements is recessed at an intermediate portion thereof with respect to the aligned intermediate portions of the other electrically-conductive element and of the electrically insulative element to increase the creepage distance for the conduction of electricity over the electrically insulative element from one electrically-conductive element to the other electrically-conductive element. Also, the inner edge of the other of said electrically-conductive elements is similarly recessed at an intermediate portion thereof opposite to that of the recessed portion of the one electrically-conductive element.

According to another aspect of the present invention, there is provided a transformer comprising a primary winding and a secondary winding electromagnetically coupled to the primary winding and including at least one electrical coil as briefly described above. In the described preferred embodiments, the secondary winding includes a plurality of coils each as described above, all connected together in parallel by a first electrical connection to one of the terminals of each coil, a second electrical connection to the other of the terminals of each coil, and a third electrical connection to the center tap of each coil.

More particularly, the first, second and third electrical connections include, respectively, a first metal fastener passing through one of the terminals of each coil, a second metal fastener passing through the other of the terminals of each coil, and a third metal fastener passing through the center tap for each coil.

According to another feature in the described preferred embodiments, the primary winding includes a plurality of spools each carrying two coils produced by winding an insulated electrical conductor from a mid-portion thereof such that the produced two coils are connected together at the mid-portion, and rotating one coil 180° with respect to the other such as to produce a current flow in the same direction in both coils when connected to a voltage source.

As will be described more particularly below, the foregoing features enable the construction of compact and efficient electrical coils and transformers having a few relatively simple parts which can be produced and assembled in volume and at relatively low cost.

Further features and advantages of the invention will be apparent from the description below.

BRIEF DESCRIPTION OF THE DRAWINGS

The invention is herein described, by way of example only, with reference to the accompanying drawings, wherein.

It is to be understood that the foregoing drawings, and the description below, are provided primarily for purposes of facilitating understanding the conceptual aspects of the invention and possible embodiments thereof, including what is presently considered to be a preferred embodiment. In the interest of clarity and brevity, no attempt is made to provide more details than necessary to enable one skilled in the art, using routine skill and design, to understand and practice the described invention. It is to be further understood that the embodiments described are for purposes of example only, and that the invention is capable of being embodied in other forms and applications than described herein.

DESCRIPTION OF A PREFERRED EMBODIMENT

Overall Transformer Construction

Figure 1:
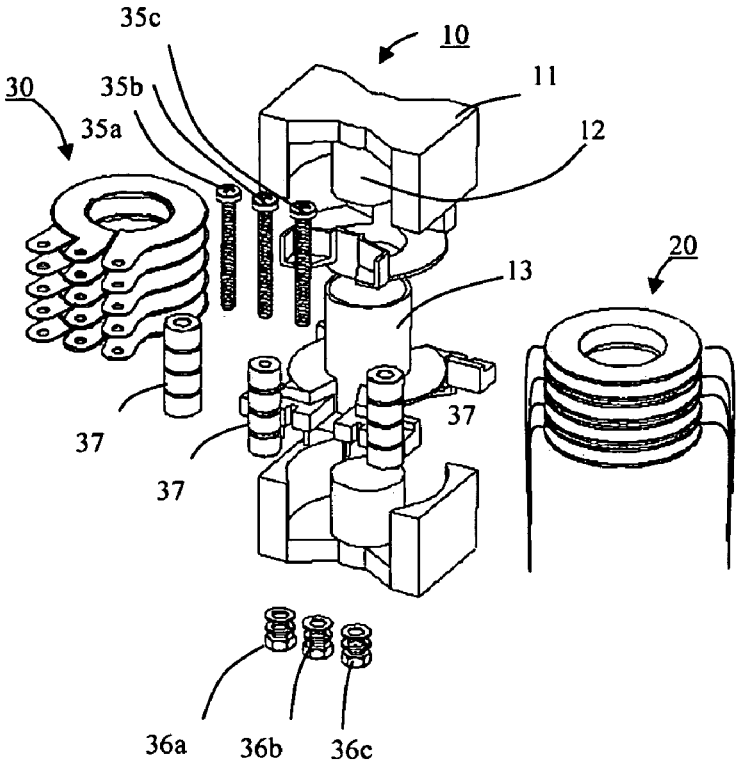
FIG. 1 is an exploded view illustrating one form of transformer constructed in accordance with the present invention.
Figure 2:
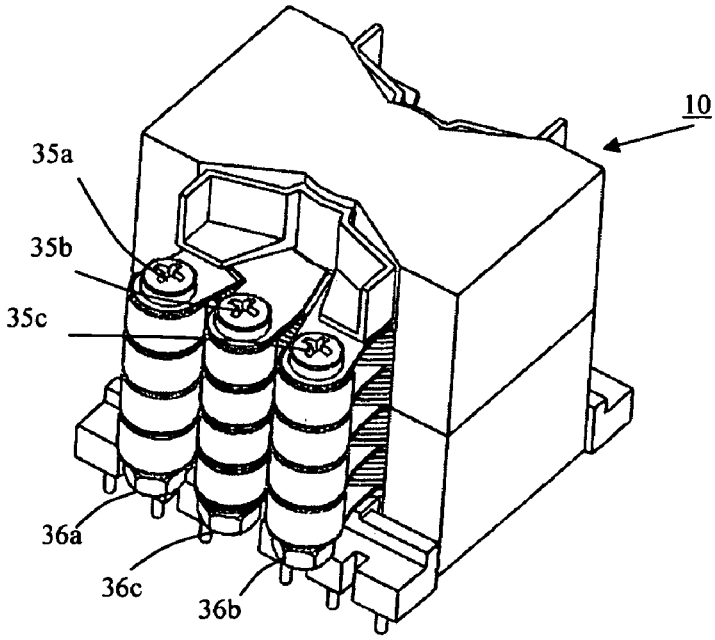
FIG. 2 is a three-dimensional view illustrating the transformer of FIG. 1 in assembled condition.

A transformer constructed in accordance with the present invention is illustrated in FIGS. 1 and 2. The illustrated transformer includes a magnetic core assembly, generally designated 10; a primary winding assembly, generally designated 20; and a secondary winding assembly, generally designated 30, electromagnetically coupled to the primary winding assembly 20.

As shown particularly in FIG. 1, the magnetic core assembly 10 includes an outer magnetic section 11, and an inner core section 12 of cylindrical configuration extending longitudinally of the transformer. As known, the inner core section 12 may be interrupted to produce an air gap to prevent saturation. The inner core section 12 is enclosed by a cylindrical bobbin 13 of electrically insulating material for supporting the two winding assemblies 20 and 30. FIG. 1 illustrates the coils of the two assemblies as being interleaved, as shown in the above-cited U.S. Pat. No. 5,331,536.

Figure 3:
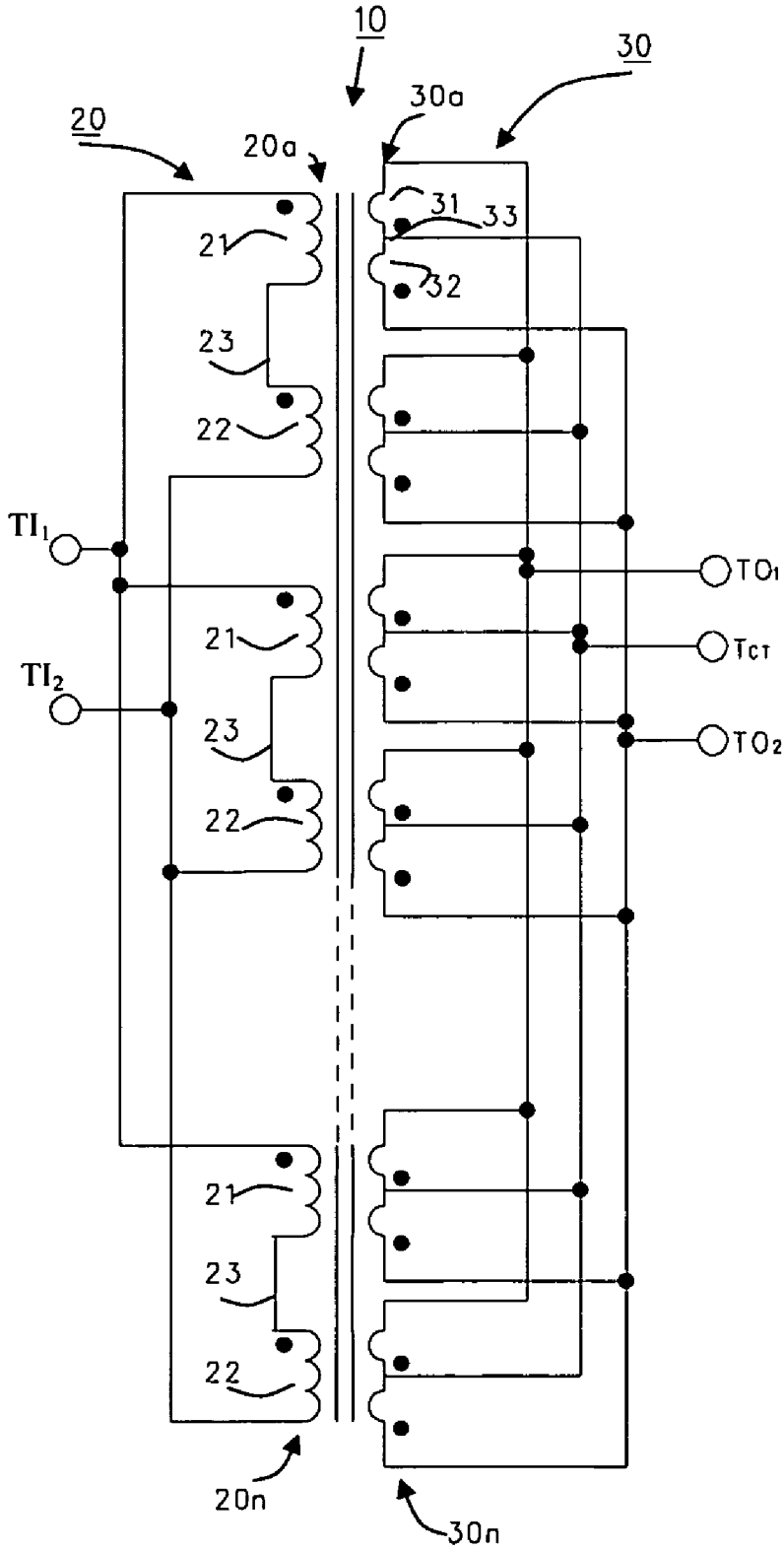
FIG. 3 is a circuit diagram of the transformer of FIGS. 1 and 2.

As shown in FIG. 3, the primary winding assembly 20 includes a plurality of coils 20*a*-20*n* all connected in parallel to the input terminals $TI_1$, $TI_2$; similarly, the secondary winding assembly 30 includes a plurality of coils 30*a*-30*n* also connected in parallel to the output terminals $TO_1$, $TO_2$. However, whereas each primary winding coil 20*a*-20*n* includes a large number of turns, each secondary winding coil 30*a*-30*n* includes but two turns since the illustrated transformer functions to step-down a high-voltage low-current AC input to the primary winding assembly 20, to a high-current low-voltage output from the secondary winding assembly 30.

As indicated earlier, such transformers are commonly used as inverters for converting a DC input to a high-current, low-voltage DC output. In such applications, the input to the primary winding 20 would be supplied with the DC but switched at high frequency, and the AC output produced by winding 30 would be rectified to DC of the requested low voltage and high current. The present invention provides improvements in the construction of the secondary winding 30 as described more particularly below with respect to FIGS. 4-15, and also improvements in the construction of the primary winding 20 as described more particularly below with respect to FIGS. 16-22.

The Construction of the Secondary Winding 30

As shown in FIG. 3, each coil 30*a*-30*n* of the secondary winding 30 is formed of two turns with a center-tap between them. The opposite ends of the 2-turn coil are connected to the two output terminals $TO_1$, $TO_2$, while the center-tap is connected to the center-tap terminal TC.

Figure 4:
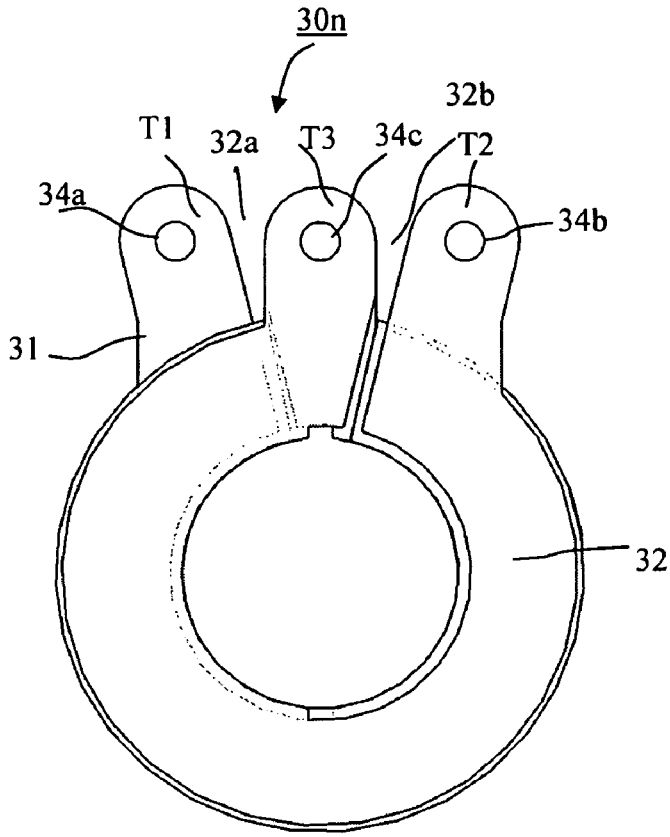
FIG. 4 illustrates one of the 2-turn electrical coils included in the secondary winding of the transformer of FIGS. 1 and 2.
Figure 5:
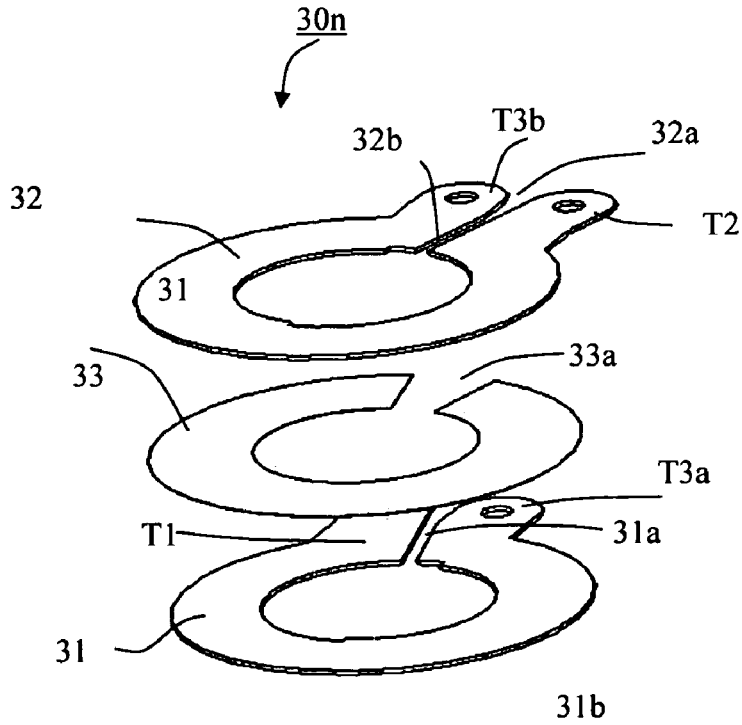
FIG. 5 is an exploded three-dimensional view of the 2-turn coil of FIG. 4.

FIGS. 4 and 5 illustrate a preferred construction of each of the 2-turn coils, therein designated 30*n*. As shown particularly in the exploded view of FIG. 5, each 2-turn coil includes: a first electrically-conductive element 31 of a thin, flat, annular configuration; a second electrically-conductive element 32 also of a thin, flat, annular configuration; and an electrically-insulative element 33 between the two conductive elements 31, 32. Each of the two conductive elements 31, 32 is formed with a gap, as shown at 31*a* and 32*a*, respectively, such that they define first and second turns of a 2-turn coil. The electrically-insulative element 33 is also formed with a gap 33*a* which is aligned with one end of each turn of the two conductive elements 31, 32, when the three elements are assembled in coaxial relationship with the insulative element 33 inbetween the two conductive elements 31, 32.

As further seen in FIG. 5, each conductive element 31, 32 is formed with first and second projecting end portions on opposite sides of the gap in the respective element. In FIG. 5, the two projecting end portions in conductive element 31 are identified as $T_1$ and $T_{3a}$; and the two projecting end portions in conductive element 32 are identified $T_{3b}$ and $T_2$, respectively.

The 2-turn center-tap coil illustrated in FIG. 4 is produced by coaxially assembling the insulated strip 33 inbetween the two conductive strips 31, 32; angularly spacing the two terminals $T_1$, $T_2$ from each other to define the two terminals of the coil; and aligning the two terminals $T_{3a}$, $T_{3b}$ with each other to define the center tap of the 2-turn coil.

Gap 33*a* of insulative element 33 is dimensioned so as to expose a linear surface, shown at 31*b* and 32*b*, respectively, of the two conductive strips 31, 32 for direct contact with each other. The two such-exposed surfaces 31*b*, 32*b* are preferably bonded to each other, e.g. by soldering or welding, in order to assure good electrical continuity between the two conduct elements 31, 32 along these exposed surfaces.

It will thus be seen that when the three elements 31-33 illustrated in FIG. 5 are assembled together in coaxial relationship as shown in FIG. 4, with the two terminals $T_1$, $T_2$ angularly spaced from each other, the two terminals $T_{3a}$, $T_{3b}$ aligned with each other, and with the exposed surfaces 31*b*, 32*b* soldered or otherwise bonded to each other, the resulting assembling is a 2-turn coil in which the two turns are defined by the two conductive elements 31, 32, respectively, having the two connector terminals $T_1$, $T_2$ and the center-tap terminal $T_3$. It will also be seen that the two turns are electrically connected together by the exposed surfaces 31*b*, 32*b* of the two conductive elements, and are insulated from each other by the electrically-insulative element 33.

As further shown in FIG. 4, the three terminals $T_1$, $T_2$ and $T_3$, are each formed with an opening 34*a*-34*c*, respectively, for receiving metal fasteners 35*a*-35*c*, respectively (FIGS. 1 and 2) for assembling a plurality of the 2-coils on the cylindrical bobbin 13, and for connecting such coils in the parallel relationship as illustrated in FIG. 3. As indicated earlier, the coils of the secondary winding 30 are preferably interleaved with those of the primary winding 20. Preferably, each of the metal fasteners 35*a*-35*c* receives a nut of other locking element 36*a*-36*c* for locking the coils in the illustrated assembled relationship, and a plurality of spacer washers 37 for spacing the coils in the assembly from each other.

Figure 6:
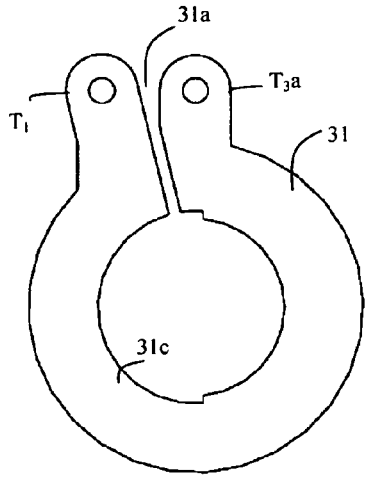
FIG. 6 is a plan view illustrating one of the electrically-conductive elements in the coil of FIGS. 4 and 5.
Figure 7:
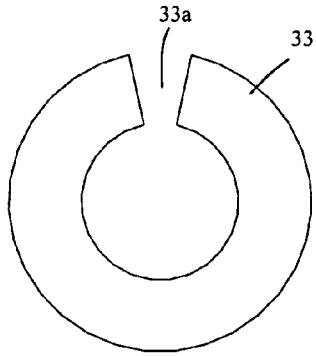
FIG. 7 is a plan view illustrating the electrically-insulative element in the coil of FIGS. 4 and 5.
Figure 8:
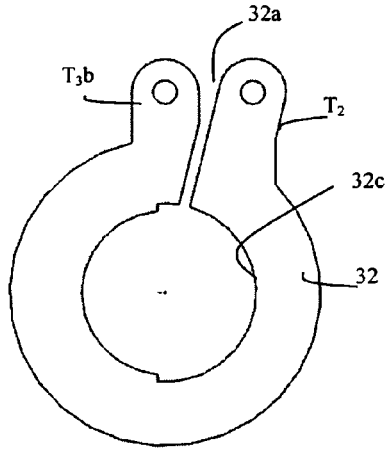
FIG. 8 is a plan view illustrating the other electrically-conductive element in the coil of FIGS. 4 and 5.

FIGS. 6-8 more particularly illustrate a preferred construction of the electrically-conductive elements 31, 32 and the electrically-insulative element 33 in the 2-turn coil of FIG. 4. As shown in FIGS. 6 and 8, the inner edge of each of the two electrically-conductive elements 31, 32 is recessed at an intermediate portion thereof, as shown at 31*c* and 32*c*, respectively, with respect to the aligned inner edge portion of the electrically-insulative element 33. Each of the recessed portions 31*c*-32*c* extends for slightly more than one-half the circumference of the inner edge of the respective conductive element. It will also be seen from FIGS. 6 and 8 that recess 31*c* of conductive element 31 is oppositely disposed from recess 32*c* of conductive strip 32. The purpose of such recesses is to increase the creepage distance for the conduction of electricity over insulative element 33 from one conductive element to the other, as we will be described more particularly below with respect to FIG. 12. As will also be described below with respect to FIG. 12, the width of insulative element 33 is slightly less than the width of the two conductive elements 31, 32, so as to also increase the creepage distance for the conduction of electricity over the outer portion of the insulative element.

Figure 9:
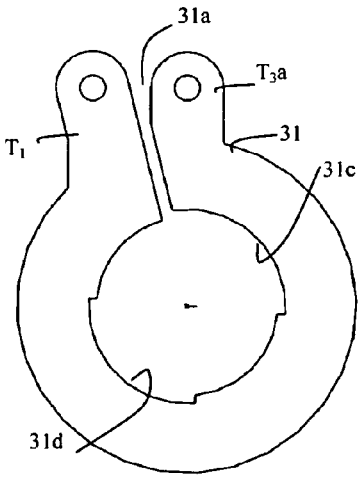
FIGS. 9, 10, and 11 are views, corresponding to those of FIGS. 6, 7, and 8 respectively, illustrating a modification in the construction of the 2-turn coil of FIGS. 4 and 5.
Figure 10:
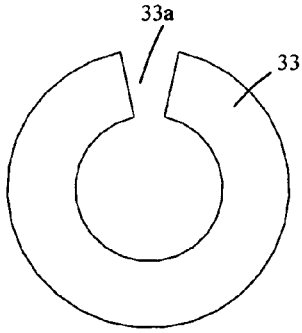
Figure 11:
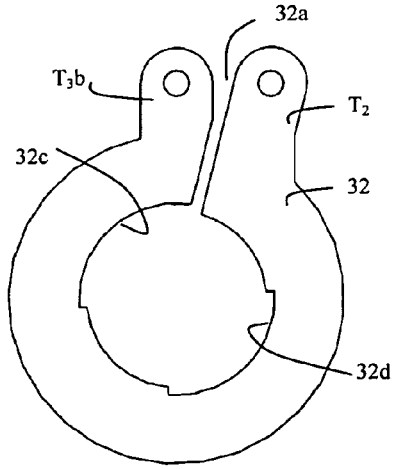

FIGS. 9-11 are views, corresponding to those of FIGS. 6-8, but illustrating a slight modification in the construction of the two conductive elements 31, 32. In this modification, the inner edge of each conductive element is formed with two recesses on opposite sides of the respective element, as shown at 31*d*, 31*e* and 32*d*, 32*e*, respectively, with each recess extending for slightly less than one-fourth the circumference of the inner edge in the respective conductive element.

Figure 12:
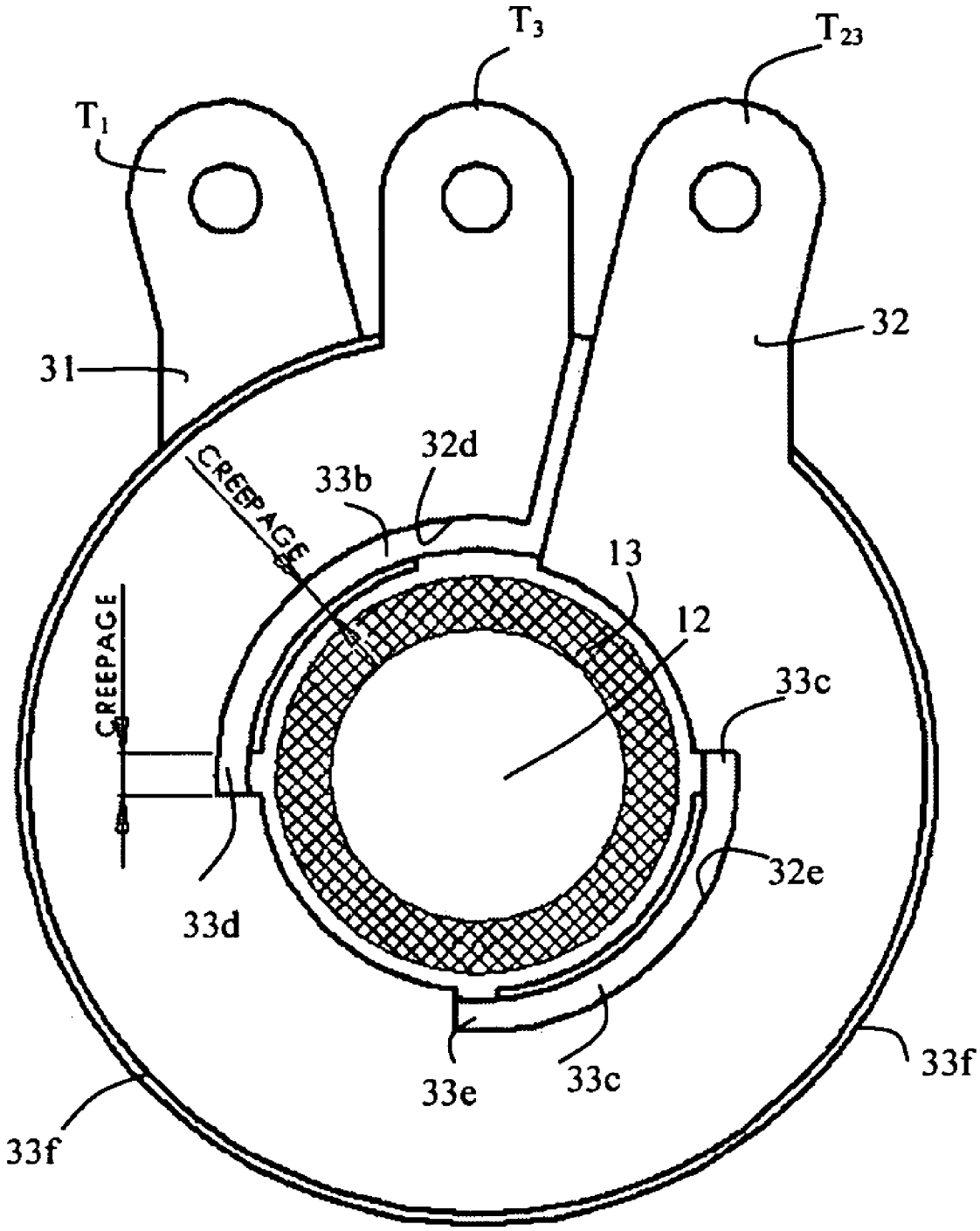
FIG. 12 is an enlarged view more particularly illustrating the modified 2-turn coil of FIGS. 9-11 in assembled condition.

FIG. 12 illustrates a 2-turn coil assembled with the conductive elements 31, 32 constructed as shown in FIGS. 9 and 11, respectively, with the insulative element 33 inbetween, and particularly how such a construction increases the creepage distance for the conduction of the electricity over the insulative element 33. Thus, as seen in FIG. 12, recess 32*d* in conductive strip 32 exposes surface 33*b* of element 33; whereas recess 32*e* in conductive element 32 exposes surface 33*c* of insulative element 33 on the opposite side of the assembled 2-turn coil. Similar surfaces of the insulative element 33 are exposed on the opposite face of the 2-turn coil by recesses 31*d* and 31*e*. Such exposed surfaces 33*b*, 33*c* of the insulative element 33, together with the corresponding surfaces on the opposite side, increase the creepage distance for the conduction of electricity over the insulative element from one conductive element to the other during the operation of the transformer.

Since each of the recesses formed on the inner edges of the two conductive elements 31, 32 extends for slightly less than one-fourth the circumference of the respective inner edge, it will be seen that further surfaces of the insulative element, as shown at 33*d* and 33*e*, respectively, are also exposed, to thereby further increase the creepage distance for the conduction of electricity from one conductive element to the other at these portions of the assembled 2-turn coil. In addition, since the width of the insulative element 33 is slightly less than that of the two conductive elements 31, 32 as indicated above, a further annular surface of the insulative element, as shown at 33*f* in FIG. 12, is also exposed, to thereby increase the creepage distance for the conduction of electricity at this portion assembled 2-turn coil.

Figure 14A:
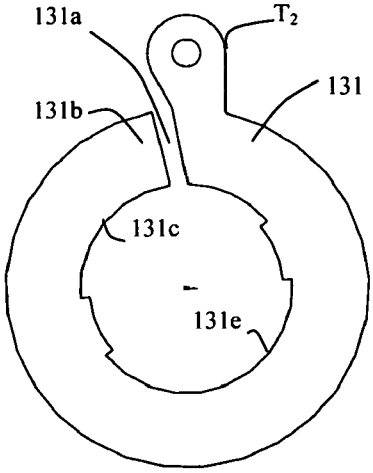
FIGS. 14*a*-14*c* illustrate the two electrically-conductive elements and the electrically-insulative element used for making the 2-turn of FIG. 13.
Figure 14B:
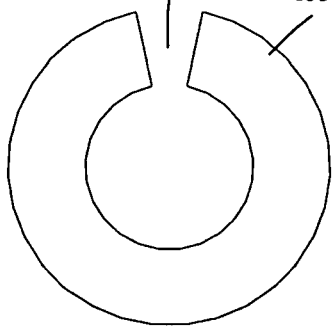
Figure 14C:
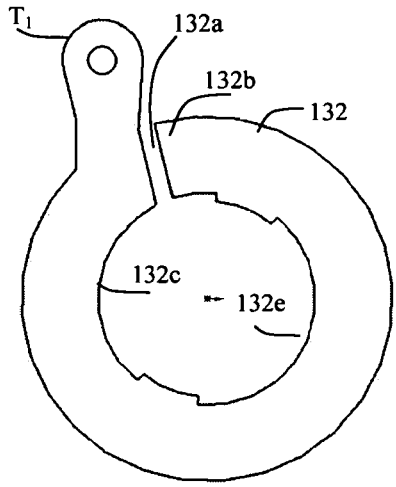
Figure 13:
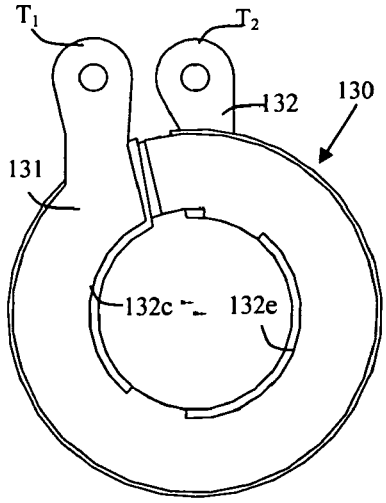
FIG. 13 is a plan view illustrating the construction of another 2-turn coil in accordance with the present invention.
Figure 15A:
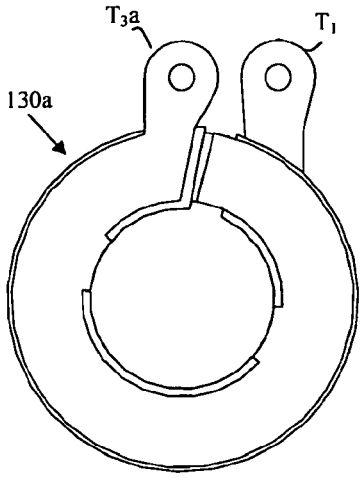
FIGS. 15*a*-15*d* illustrate the manner of assembling two 2-turn coils as illustrated in FIGS. 13 and 14*a*-14*c* for producing a 4-turn coil having a center tap.
Figure 15B:
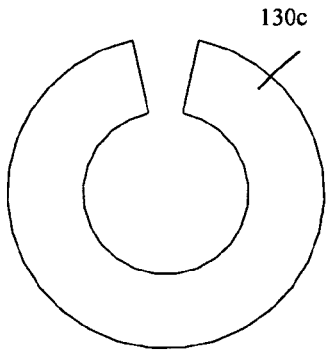
Figure 15C:
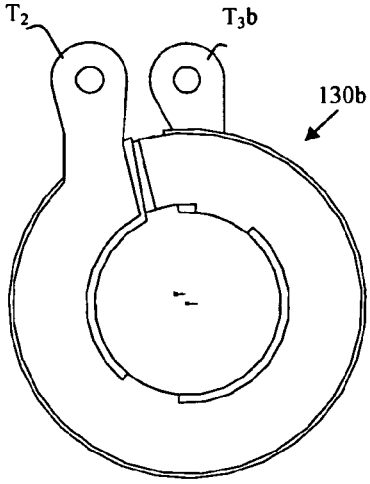
Figure 15D:
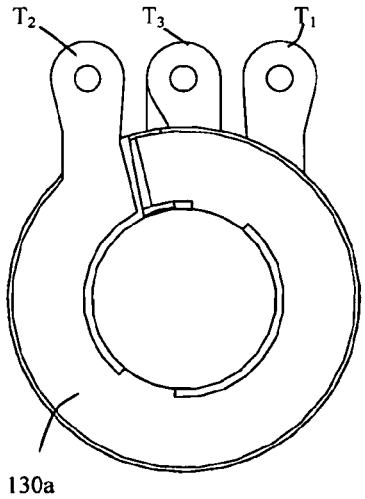

FIG. 13 illustrates the construction of 2-turn coil, therein designated 130, constructed as described above but without providing a center-tap; and FIGS. 14*a*-14*c* illustrate the construction of the two conductive elements 131, 132, and the insulative element 133 inbetween, to produce such a 2-turn coil. Thus, as shown in FIGS. 14*a* and 14*c*, each of the conductive elements 131, 132 is formed with only one rejecting end portion, shown at $T_1$ and $T_2$, respectively, to define the two terminals $T_1$, $T_2$ of the so-produced 2-turn coil. That is, the second projecting end portion at the other side of the gap in the respective conductive element is omitted, such that the conductive element at the other side of its respective gap 131*a*, 132*a*, is left bare, as shown at 131*b*, 132*b*, respectively, for bonding to each other, e.g. by soldering or welding, to produce a single 2-turn coil having merely the two terminals $T_1$, $T_2$, and no center-tap terminal corresponding to $T_3$ in FIG. 12, for example. The conductive elements 131, 132 may be otherwise constructed with the recesses 131*d*, 131*e* and 132*d*, 132*e*, on their inner edges as described above with respect to FIG. 12, to increase the creepage distance for the conduction of electricity over the insulative element 133.

FIGS. 15*a*-15*d* illustrate how two of the 2-turn coils 130 of FIG. 13 may be assembled to produce a 4-turn coil having a center tap. This is done by assembling a first 2-turn coil 130*a* (FIG. 15*a*) and a second 2-turn coil 130*b* (FIG. 15*c*) between another electrically-insulative element 130*c*, with one terminal $T_1$ of coil 130*a* angularly spaced from one terminal $T_2$ of coil 130*b*, and with the other terminals $T_{3a}$, $T_{3b}$ aligned with each other, to thereby produce the 4-turn coil illustrated in FIG. 15*d* having the two connector terminals $T_1$, $T_2$, and the center-tap $T_3$.

The Construction of the Primary Winding 20

As shown in FIG. 3, the primary winding 20 includes a plurality of coils each having a plurality of turns of insulated wire connected in parallel between the input terminals $TI_1$, $TI_2$ of the transformer. According to a feature of the present invention, the primary winding includes a plurality of spools each carrying two coils, shown at 21 and 22 in FIG. 3, produced by winding an insulated electrical conductor from a mid-portion thereof, shown at 23, such that the produced two coils are connected together at the mid-portion. Before the two coils are mounted on the same spool, one coil is rotated 180° with respect to the other such that both coils on a spool produce a current flow in the same direction.

The foregoing features are more particularly illustrated in FIGS. 16-22.

Figure 16:
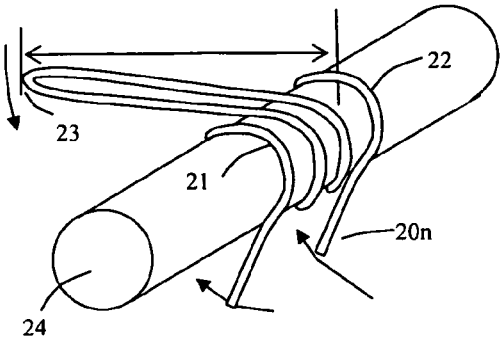
FIGS. 16-20 are diagrams illustrating a preferred manner of constructing each double-coil of the primary winding in the transformer of FIGS. 1-3.
Figure 17:
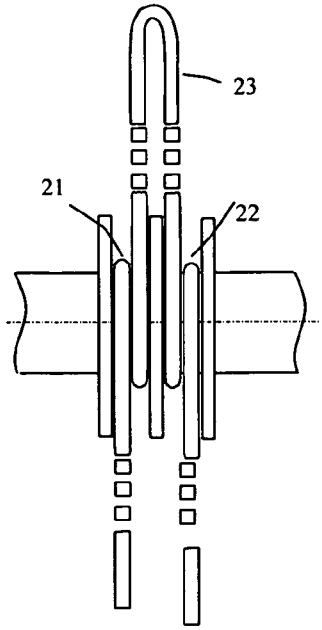
Figure 18:
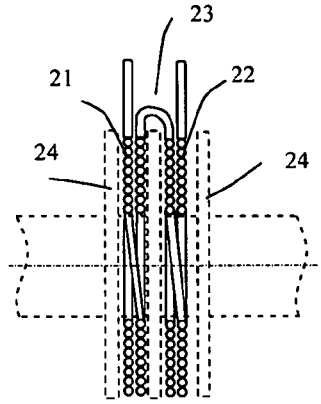
Figure 19:
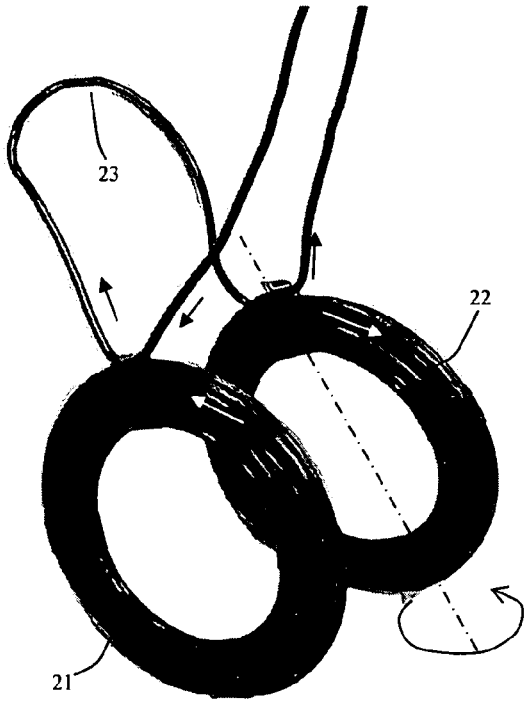
Figure 20:
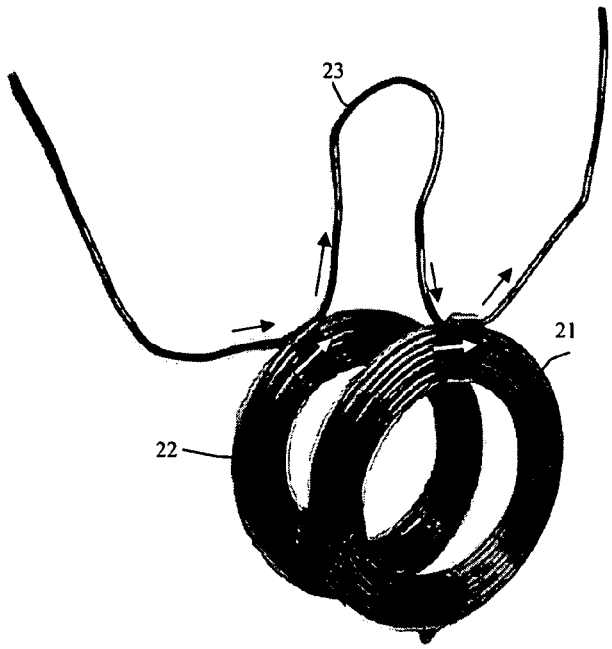

Thus, as shown in FIGS. 16-18, an insulated electrical conductor, generally designated 20*n*, is wound on a winding machine 24 to define two coils 21, 22 connected together at their mid-portion 23. As shown in FIG. 19, when the two coils 21, 22 are so produced, the turns would be such that the current flow in the two coils would be in the opposite direction. Thus, as shown in FIG. 19, the current flow through coil 21 is counter-clockwise, whereas the current flow in coil 22 is clockwise. Accordingly, one coil, in this case coil 21, is rotated 180° with respect to the other coil 22, as shown in FIG. 20, such that the current flow through both coils would be in the same direction, namely clockwise in this case.

Figure 21:
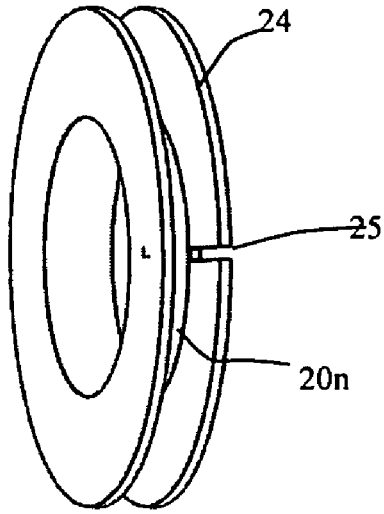
FIG. 21 is a three dimensional view illustrating the bobbin for holding each double-coil of the primary winding of FIGS. 16-20.
Figure 22:
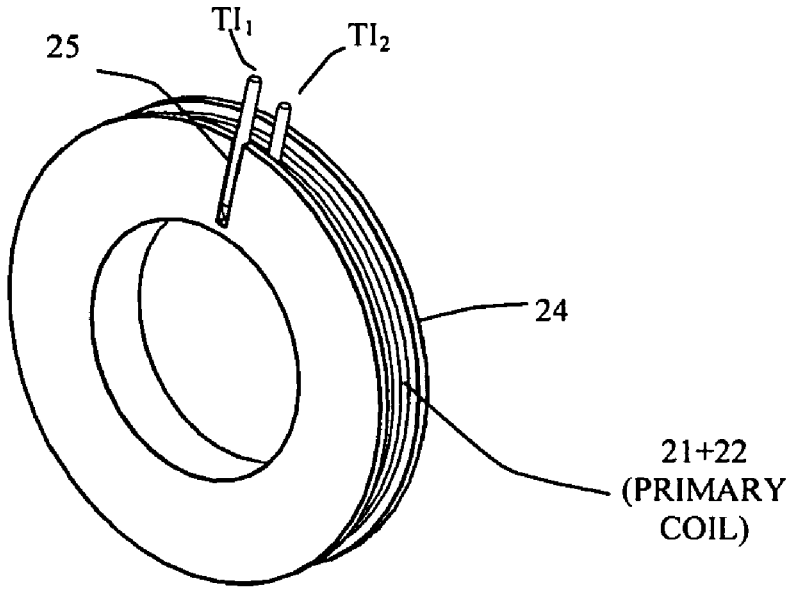
FIG. 22 is three-dimensional view illustrating the double-coil in the primary winding in the transformer of FIGS. 1 and 2.

FIG. 21 illustrates a spool 24 carrying a double-coil produced as described above, namely one constituted of two coils 21, 22, connected together at a mid-portion 23. As shown in FIG. 21, the sidewalls of each spool 24 are flat, to permit a plurality of such spools, each carrying a double-coil, to be stacked with respect to each other. One of the sidewalls may be formed with a radial slot, as shown at 25, to permit the wires of a plurality of such double-coils to be connected to the input terminals $TI_1$, $TI_2$ in the parallel arrangement illustrated in FIG. 3.

While the invention has been described with respect to several preferred embodiments, it will be appreciated that these are set forth merely for purposes of example, and that many other variations, modifications and applications of the invention may be made.

What is claimed is:

1. An electrical coil of at least two turns, comprising:

a first electrically-conductive element of a thin, flat, annular configuration formed with a gap to define a first turn of the coil;

a second electrically-conductive element also of a thin, flat, annular configuration and also formed with a gap to define a second turn of the coil, said second electrically-conductive element being disposed coaxially with respect to said first electrically-conductive element;

and electrical insulation between said first and second electrically-conductive elements insulating said first turn from said second turn except for one end of each turn to be electrically connected together;

characterized in that said insulation includes an electrically-insulative element also of a thin, flat, annular configuration disposed coaxially between said first and second electrically-conductive elements and formed with a gap aligned with said one end of each turn to permit said ends to be electrically connected together.

2. The electrical coil according to claim 1, wherein the ends of the two turns to be electrically connected together are joined by soldering or welding.

3. The electrical coil according to claim 1, wherein each of said first and second electrically-conductive elements is formed with first and second projecting end portions on opposite sides of the gap in the respective element; said first projecting end portions of the two electrically-conductive elements being angularly spaced from each other to define two terminals of the coil; said second projecting end portions of the two electrically-conductive elements being aligned with each other to define a center tap for said coil.

4. The electrical coil according to claim 1, wherein the inner edge of one of said electrically-conductive elements is recessed at an intermediate portion thereof with respect to aligned intermediate portions of the other electrically-conductive element and of said electrically insulative element to increase the creepage distance for the conduction of electricity over said electrically insulative element from one electrically-conductive element to the other electrically-conductive element.

5. The electrical coil according to claim 4, wherein the inner edge of the other of said electrically-conductive elements is similarly recessed at an intermediate portion thereof opposite to that of the recessed portion of said one electrically-conductive element.

6. The electrical coil according to claim 1, wherein the inner edge of one of said electrically-conductive elements is recessed at two opposed intermediate portions thereof with respect to the aligned intermediate portions of the other of said electrically-conductive element and of said electrically insulated element to increase the creepage distance for the conduction of electricity over said electrically insulative from one electrically-conductive element to the other electrically-conductive element.

7. The electrical coil according to claim 6, wherein the inner edge of the other of said electrically-conductive elements is similarly recessed at two intermediate portions thereof opposite to those of said recessed intermediate portions of the one electrically-conductive element.

8. The electrical coil according to claim 1, wherein said first and second electrically-conductive elements, and said electrically insulative element, are of circular configuration.

9. The electrical coil according to claim 1, wherein each of said first and second electrically-conductive elements is formed with only one projecting end portion on one side of its gap, the opposite side of the gap in the two electrically-conductive elements being electrically connected together such that said projecting end portions of the two electrically-conductive elements serve as two terminals of a 2-turn coil.

10. The electrical coil according to claim 9, wherein the electrical coil includes two 2-turn coils assembled coaxially with each other, with a further electrically-insulative strip inbetween, and with one terminal of the two 2-turn coils aligned with each other aligned terminal, such as to define a 4-turn coil having two angularly spaced terminal, and a center-tab defined by said aligned terminals.

* * * * *